US012607107B2

(12) United States Patent
El Mallawany et al.

(10) Patent No.: US 12,607,107 B2
(45) Date of Patent: Apr. 21, 2026

(54) SLEEVE FOR MULTI-STAGE WELLBORE STIMULATION

(71) Applicant: Halliburton Energy Services, Inc., Houston, TX (US)

(72) Inventors: Ibrahim El Mallawany, Al-Khobar (SA); Ahmed Saber Mohamed, Al Khobar (SA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/894,528

(22) Filed: Sep. 24, 2024

(65) Prior Publication Data

US 2026/0085597 A1 Mar. 26, 2026

(51) Int. Cl.

| | |
|---|---|
| ***E21B 43/26*** | (2006.01) |
| ***E21B 33/12*** | (2006.01) |
| ***E21B 43/08*** | (2006.01) |

(52) U.S. Cl.

CPC ..... *E21B 43/26* (2013.01); *E21B 33/1208* (2013.01); *E21B 43/08* (2013.01); *E21B 2200/08* (2020.05)

(58) Field of Classification Search

CPC .... E21B 43/26; E21B 2200/06; E21B 34/142; E21B 34/14; E21B 43/08; E21B 34/06; E21B 33/068

See application file for complete search history.

(56) References Cited

U.S. PATENT DOCUMENTS

| | | | | |
|---|---|---|---|---|
| 7,703,510 | B2 | 4/2010 | Xu | |
| 8,297,358 | B2 * | 10/2012 | Korkmaz | E21B 34/14 166/308.1 |
| 9,394,777 | B2 | 7/2016 | Cheng et al. | |

(Continued)

FOREIGN PATENT DOCUMENTS

| | | |
|---|---|---|
| WO | 2016106447 | 7/2016 |
| WO | 2023230326 | 11/2023 |
| WO | 2024054619 | 3/2024 |

OTHER PUBLICATIONS

"PCT Application No. PCT/US2024/050292 International Search Report and Written Opinion", Jun. 16, 2025, 12 pages.

(Continued)

*Primary Examiner* — Zakiya W Bates

(74) *Attorney, Agent, or Firm* — DeLizio, Peacock, Lewin and Guerra, LLP

(57) ABSTRACT

An assembly to be positioned in a wellbore formed in a subsurface formation, that comprises a tubular housing having a bore therethrough; and a fracking sleeve comprising, a closing fracking baffle; wherein the fracking sleeve is to axially move from the closed position to an open position to open the at least one stimulation port to communicate a flow of the bore fluid out to the subsurface formation; wherein the fracking sleeve is to move from the open position to the closed position in response to the closing fracking baffle receiving an object received therein; and a production screen sleeve positioned above the fracking sleeve and that comprises a production baffle configured to move from a closed position to an open position upon receipt of a second object before being received by the closing fracking baffle; and a production screen through which production fluid is to be received.

20 Claims, 21 Drawing Sheets

(56) References Cited

U.S. PATENT DOCUMENTS

| | | | |
|---|---|---|---|
| 10,533,397 | B2 | 1/2020 | Fuxa et al. |
| 10,669,830 | B2 | 6/2020 | Facca et al. |
| 11,634,969 | B2 | 4/2023 | Stolboushkin et al. |
| 11,634,974 | B2 | 4/2023 | Zachariah et al. |
| 12,037,874 | B1 | 7/2024 | Mohamed et al. |
| 12,104,462 | B1 | 10/2024 | El Mallawany et al. |
| 2009/0056952 | A1 | 3/2009 | Churchill |
| 2009/0084553 | A1 | 4/2009 | Rytlewski et al. |
| 2013/0062066 | A1 | 3/2013 | Broussard et al. |
| 2014/0014340 | A1 | 1/2014 | King |
| 2014/0041876 | A1* | 2/2014 | Fleckenstein ..... E21B 43/14 166/329 |
| 2017/0058643 | A1* | 3/2017 | Snider ..... E21B 34/142 |
| 2017/0067314 | A1 | 3/2017 | Flores Perez et al. |
| 2018/0347330 | A1 | 12/2018 | Facca et al. |
| 2019/0100980 | A1 | 4/2019 | Fuxa et al. |
| 2020/0362668 | A1 | 11/2020 | Fripp et al. |

OTHER PUBLICATIONS

Gomez, "Novel Multi-Stage Fracturing Sand Control Technology to ImproveCompletion Efficiency, Early Production and Reduce Well Cost", International Petroleum Technology Conference DOI 10.2523/IPTC-22198-MS held in Riyadh, Saudi Arabia, Feb. 21-23, 2022, Feb. 2022, 16 pages.

* cited by examiner

SLEEVE FOR MULTI-STAGE WELLBORE STIMULATION

BACKGROUND

As part of hydrocarbon recovery from subsurface formations into which a wellbore is formed, different zones of the subsurface formations may be stimulated in order to assist and maximize recovery of hydrocarbons. For example, stimulation may enable extraction of hydrocarbons that may be trapped in unconventional formations.

BRIEF DESCRIPTION OF THE DRAWINGS

Embodiments of the disclosure may be better understood by referencing the accompanying drawings.

DESCRIPTION

Figure 1:
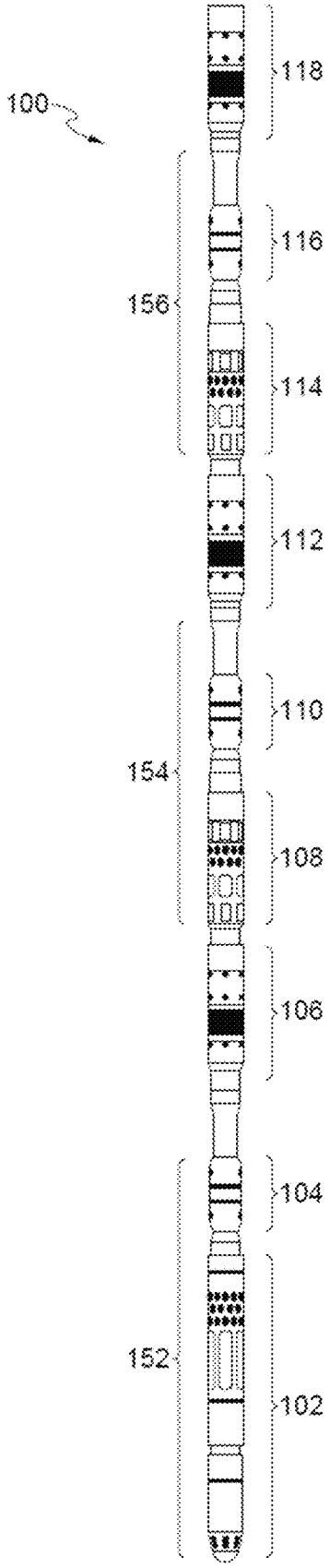
FIG. 1 is a perspective view of an example assembly (to be positioned in a workstring downhole in a wellbore) having fracking sleeves and production screen sleeves, according to some implementations.

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

Example implementations relate to downhole wellbore stimulation and hydrocarbon recovery. As further described below, example implementations may include a multi-stage fracturing system that incorporates interventionless production screens. Example implementations may include sleeves (to be positioned in a wellbore) to be used for stimulation operations.

In some implementations, a fracking sleeve may include two separate sleeves (upper and lower). Each sleeve may have an associated baffle. For example each sleeve may have a single entry (SE) baffle. During operation, when a ball is dropped on the lower sleeve, the fracking sleeve may open. When a second ball is dropped on the upper sleeve, the fracking sleeve may close. Additionally, the same ball that closes the fracking sleeve may open a production screen with a multi-entry (ME) baffle that is positioned above the fracking sleeve.

For example, in some implementations, after the production screen sleeve (that includes the production screen) is opened, a delay mechanism may initially preclude a flow path for flow of the fluid to the production screen. For instance, the delay mechanism may preclude the creation of the flow path to the production screen until after delay that ensures that a sufficient flow will move the ball to the fracking sleeve below to close the fracking sleeve. In some implementations, the delay mechanism may be a piston that is to move to open a flow path to the production screen based on a pressure of the fluid. When the multi-entry baffle of the production screen sleeve opens, the flow path to the production screen may remain plugged by a piston that may be pinned by a shear member at a higher pressure than the baffles of the fracking sleeve below. This allows tubing pressure to be increased to close the fracking sleeve below. In some implementations, the delay mechanism may be a dissolvable plug that is to dissolve over time based on exposure to the fluid. Additionally, after the fracking sleeve below is closed during the delay, the flow path from the bore through the production screen creates a flow path from the surface of the wellbore out to the subsurface formation. This flow path may be needed to create a flow to allow a next object to flow down through the bore, especially in horizontal wells, and to be seated on a baffle to open the fracking sleeve above.

Alternatively, the flow path through the screen may be choked, like for example nozzle ICD applications. In this embodiment the pressure required to close the frac sleeve below is generated by flowing above a certain flow rate through a nozzle. The nozzle could be an erodible nozzle that slowly erodes and opens when flowing at a certain flow rate for a certain time to allow more flow rate. The nozzle could also be permanent to control production flow like in ICD applications. For horizontal well applications the nozzles should allow sufficient flow rate to pump the balls to their respective seats. The screen may be designed to allow high flow rate at a high pressure drop. The high pressure drop may be needed to close the fracking sleeve below. The high flow rate may be needed to pump a ball to open the fracking sleeve above. The ball then lands on top baffle of the fracking sleeve-causing the fracking sleeve to close. This process may be repeated for incrementally larger balls. Example implementations may include a pressure-based fracking sleeve for opening the fracking sleeve. A ball may then be dropped to open the production screen above and continue down to close the fracking sleeve.

In some implementations, the fracking sleeve works by dropping a ball on the bottom baffle to open the fracking sleeve and start production. After fracking is complete an incrementally larger ball may be dropped. This incrementally larger ball may first open the production screen above the fracking sleeve. The screen may include a multi-entry baffle so the ball may pass through after the production screen is open to close the fracking sleeve below.

In some implementations, a wellbore system may include multiple sleeves positioned at different depths along the wellbore formed in a subsurface formation. Each sleeve may be associated with a different zone of the subsurface formation, such that a given zone may be stimulated with fluid using stimulation ports of the sleeve. For example, a given zone may be stimulated as part of fracking operations. One zone at a time may be stimulated. In some implementations, the zone that is deepest in the wellbore is stimulated first, followed by the zone above, etc. until the zone nearest the surface of the wellbore is stimulated.

Some implementations may include more than one production screen for a given zone. In such implementations, dissolvable material may plug the flow ports of the production screen. On the outer diameter side, a seal may protect the dissolvable plug from exposure to wellbore fluids. The inner diameter side the plug may be exposed to a non-dissolving fluid contained by the O-rings. Once opened, the plug starts to disintegrate. The plug may only need to hold pressure for a few minutes until all ME sleeves are open and the fracking sleeve is closed.

Example Assembly

An example assembly is now described. FIG. 1 is a perspective view of an example assembly (to be positioned in a workstring downhole in a wellbore) having fracking sleeves and production screen sleeves, according to some implementations. In FIG. 1, an assembly 100 includes a tool initiator sub 102, a production screen sleeve 104, a packer 106, a fracking sleeve 108, a production screen sleeve 110, a packer 112, a fracking sleeve 114, a production screen sleeve 116, and a packer 118. The tool initiator sub 102 and the production screen sleeve 104 are within a first zone 152 of the subsurface formation. The fracking sleeve 108 and the production screen sleeve 110 are within a second zone 154 of the subsurface formation. The fracking sleeve 114 and the production screen sleeve 116 are within a third zone 156 of the subsurface formation.

As shown in this example, the tool initiator sub 102 is positioned at a bottom position. The production screen sleeve 104 is positioned above the tool initiator sub 102. The packer 106 is positioned above the production screen sleeve 104. The fracking sleeve 108 is positioned above the packer 106. The production screen sleeve 110 is positioned above the fracking sleeve 108. The packer 112 is positioned above the production screen sleeve 110. The fracking sleeve 114 is positioned above the packer 112. The production screen sleeve 116 is positioned above the fracking sleeve 114. The packer 118 is positioned above the production screen sleeve 116. While FIG. 1 depicts a particular number of fracking sleeves, production sleeve sleeves, and packers, there may be a lesser or greater number of these components. As further described below, the tool initiator sub 102 may be a pressure activated sleeve, while the fracking sleeves 108 and 114 are activated via an object (e.g., a ball) being dropped down into the sleeve.

As further described below, the tool initiator sub 102 is first opened by a pressure from a flow of fluid to enable fracking in the first zone 152. After fracking is complete in the first zone 152, a first object is dropped down through a bore of the assembly 100. The dropping of the first object first opens the production screen sleeve 104 and then closes the tool initiator sub 102. Then, a second object is dropped down through the bore of the assembly 100 to open the fracking sleeve 108 to enable fracking in the second zone 154. After fracking is complete in the second zone 154, a third object is dropped down through a bore of the assembly 100. The dropping of the third object first opens the production screen sleeve 110 and then closes the fracking sleeve 108.

Then, a fourth object is dropped down through the bore of the assembly 100 to open the fracking sleeve 114 to enable fracking in the third zone 156. After fracking is complete in the third zone 156, a fifth object is dropped down through a bore of the assembly 100. The dropping of the fifth object first opens the production screen sleeve 116 and then closes the fracking sleeve 114. The assembly 100 may be a closed system—wherein applying a flow through the bore of the assembly 100 may set the packers 106, 112, and 118.

In some implementations, the objects being dropped into the baffles may be composed of dissolvable material so these objects may provide enough pressure for fracking then these objects may self-disintegrate in the wellbore fluid after some time to allow unobstructed flow. Alternatively the objects may be flowed back into a larger inner diameter to allow flow around them or to the surface.

In some implementations, fracking may be performed at each of the different zones. After fracking is complete, production of hydrocarbons from the subsurface formation through the different production screen sleeves 104, 110, 116 may be initiated.

Figure 2:
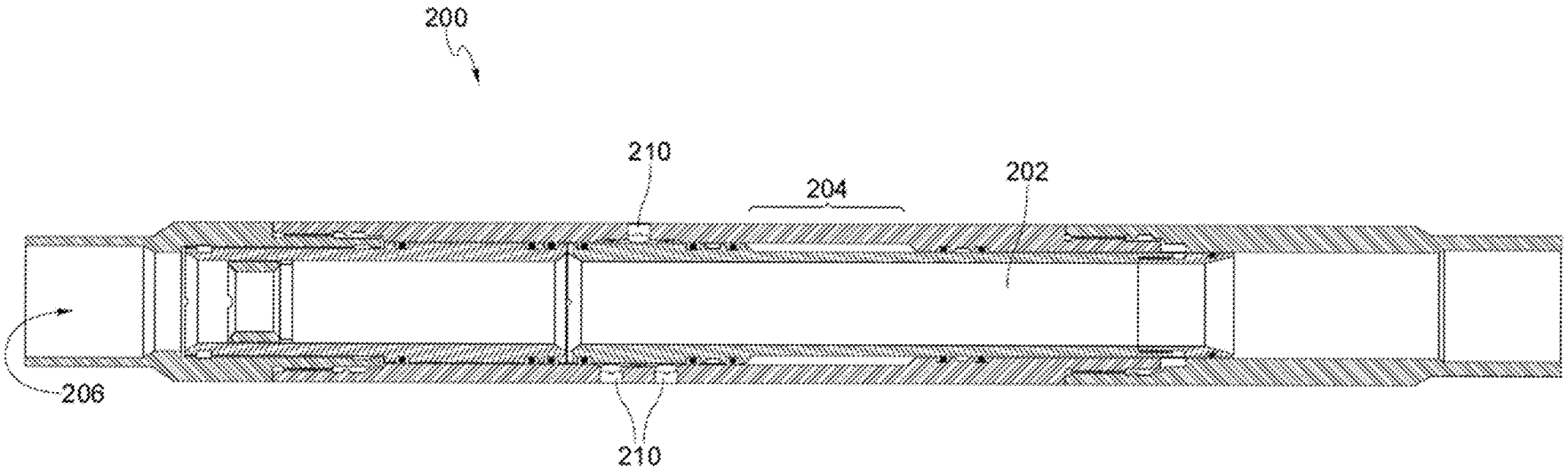
FIG. 2 is a side cross-sectional view of a pressured-based fracking sleeve in a closed position, according to some implementations.
Figure 3:
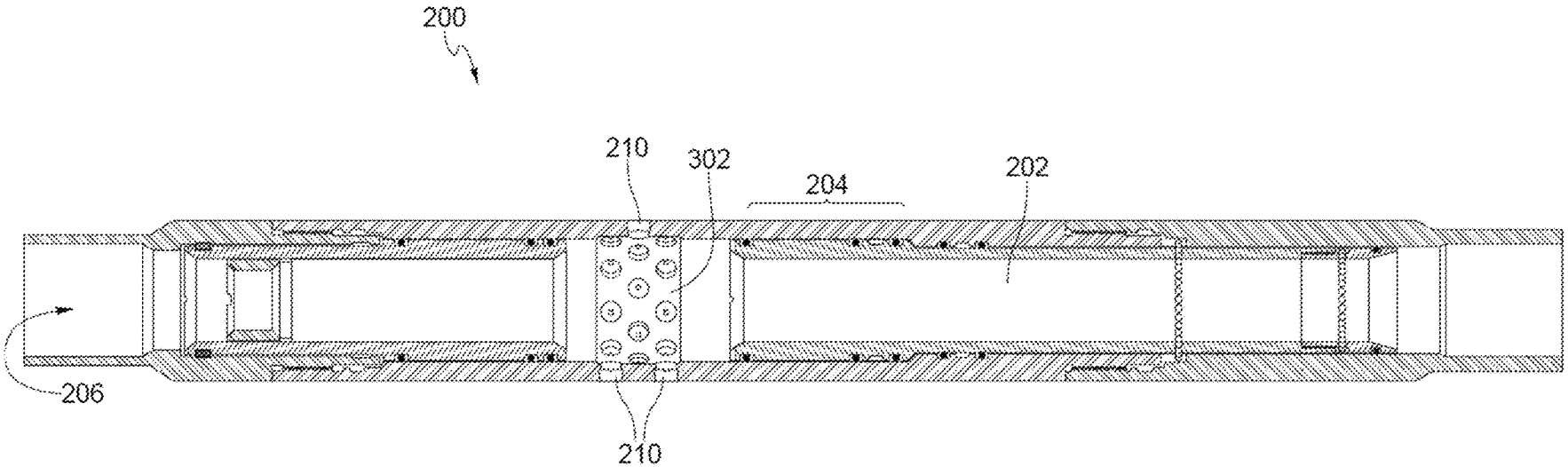
FIG. 3 is a side cross-sectional view of the pressure-based fracking sleeve of FIG. 2 in an open position, according to some implementations.
Figure 4:
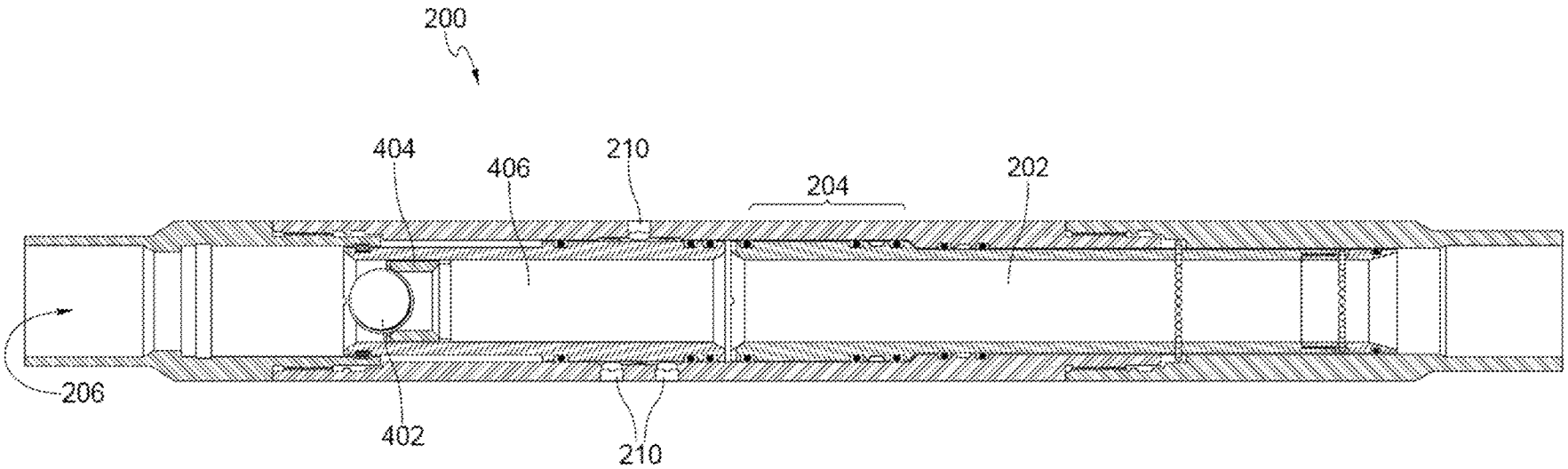
FIG. 4 is a side cross-sectional view of the pressure-based fracking sleeve of FIG. 3 after the sleeve is closed, according to some implementations.
Figure 5:
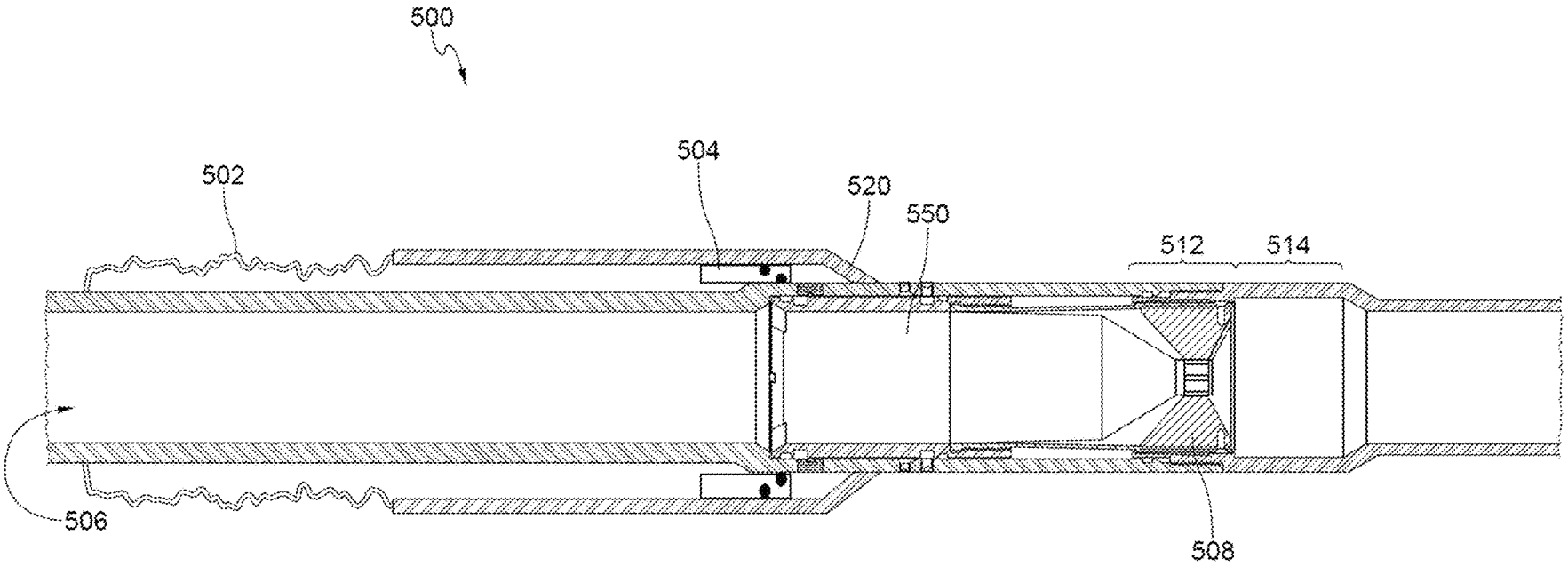
FIG. 5 is a side cross-sectional view of a production screen sleeve in a closed position, according to some implementations.
Figure 6:
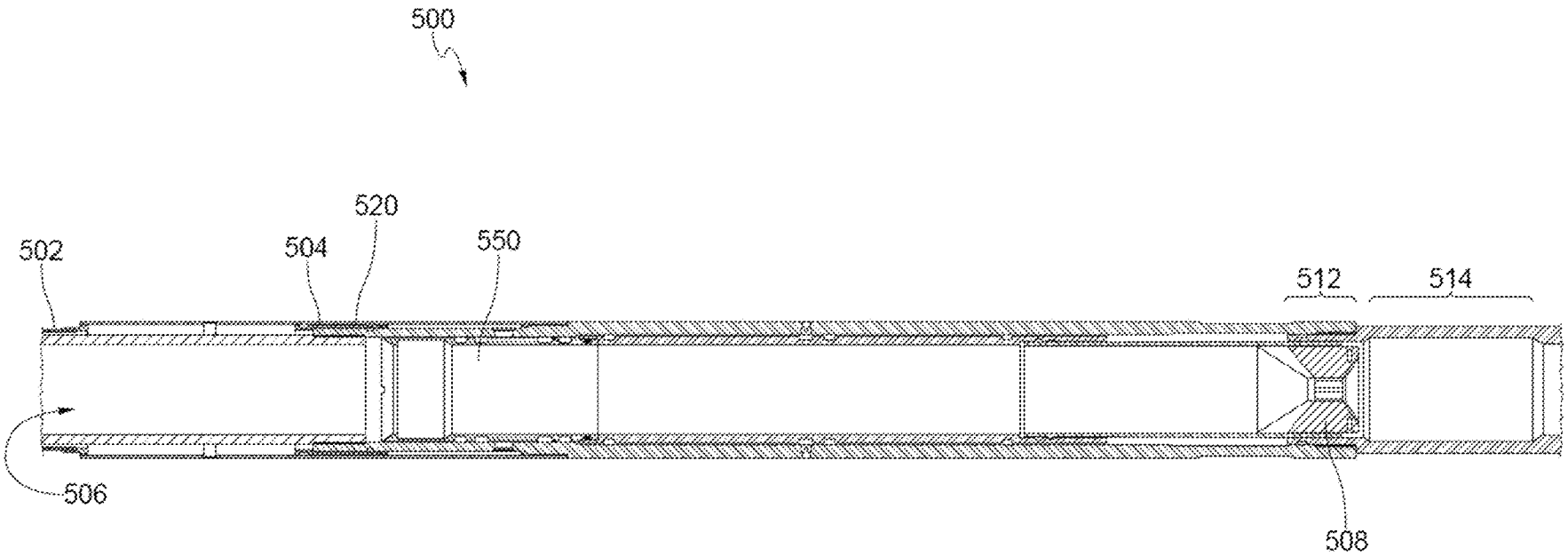
FIG. 6 is a more detailed side cross-sectional view of a production screen sleeve in a closed position, according to some implementations.
Figure 12:
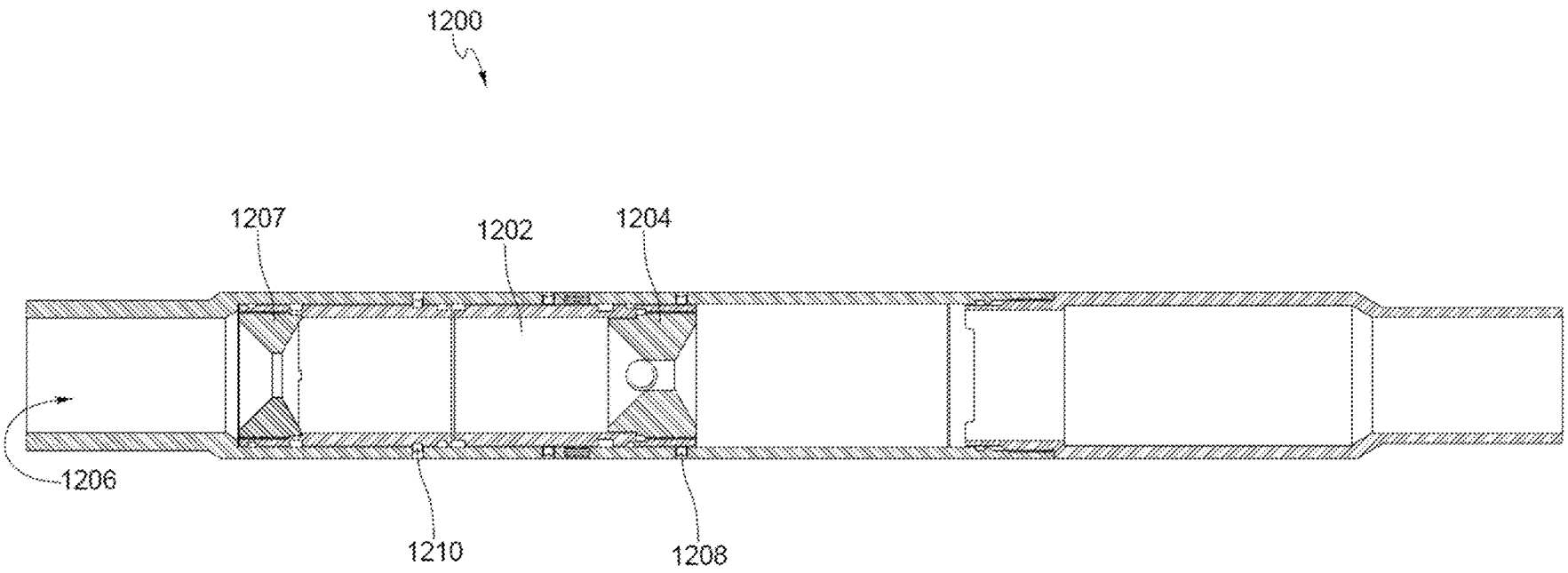
FIG. 12 is a side cross-sectional view of a fracking sleeve in a closed position, according to some implementations.
Figure 13:
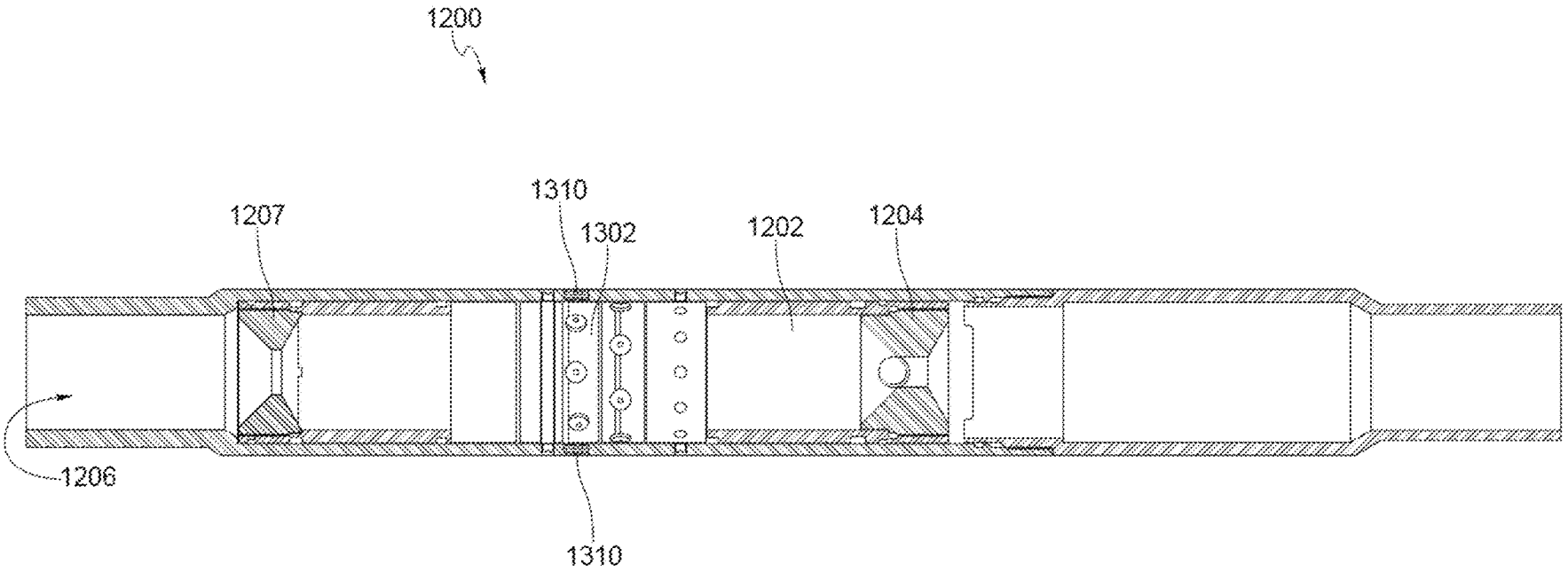
FIG. 13 is a side cross-sectional view of the fracking sleeve of FIG. 12 in an open position, according to some implementations.
Figure 14:
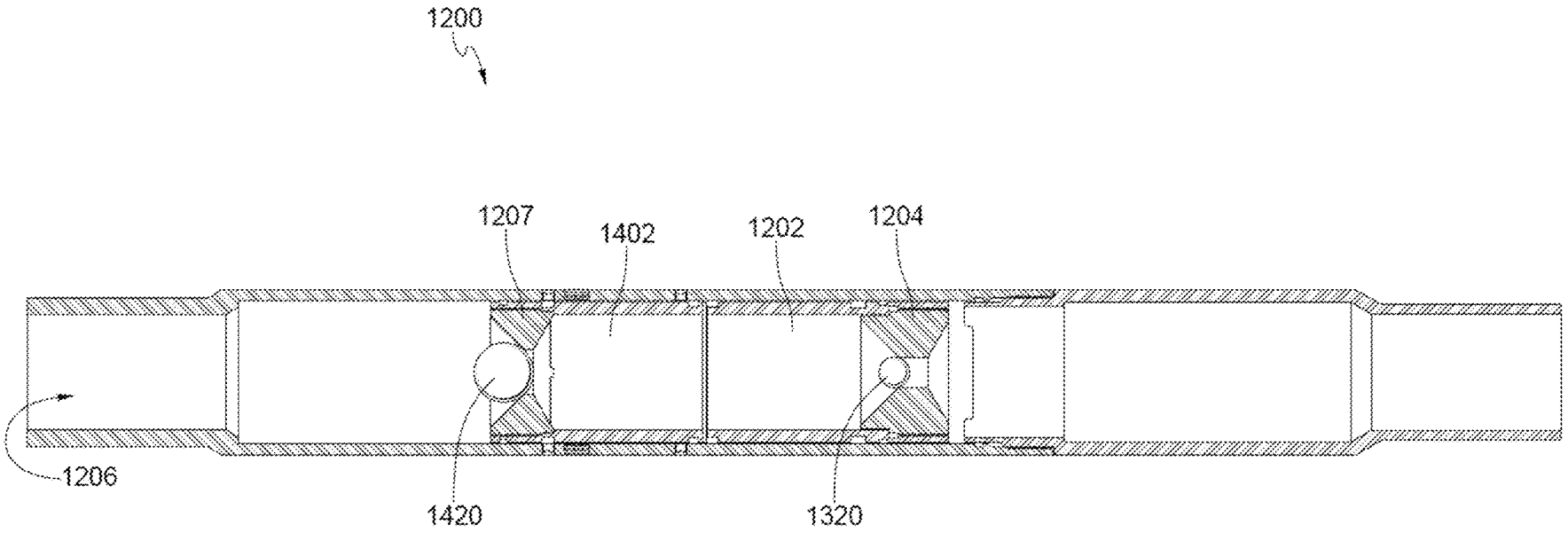
FIG. 14 is a side cross-sectional view of the fracking sleeve of FIG. 13 after the sleeve is closed, according to some implementations.

An example of the tool initiator sub 102 at different stages is depicted in FIGS. 2-4 (further described below). An example of the fracking sleeves 108 and 114 is depicted in FIGS. 12-14 (further described below). An example of the production screen sleeves 104, 110, and 116 is depicted in FIGS. 5-6 (further described below).

An example of the tool initiator sub 102 of FIG. 1 at different stages is now described with reference to FIGS. 2-4. In particular, FIG. 2 is a side cross-sectional view of a pressured-based fracking sleeve in a closed position, according to some implementations. FIG. 2 depicts a pressure-based fracking sleeve 200 having a sleeve 202 that slides to the right into a spacing 204 as fluid pressure flows down through a bore 206 from a surface of the wellbore and into the pressured-based fracking sleeve 200. The pressure-based fracking sleeve 200 also includes stimulation ports 210. FIG. 3 is a side cross-sectional view of the pressure-based fracking sleeve of FIG. 2 in an open position, according to some implementations. As shown, the sleeve 202 has slid to the right into the spacing 204 so that the openings 302 are revealed. A fracturing fluid may flow through the bore 206 and out into a subsurface formation through the openings 304 via the stimulation ports 210.

The pressure based fracking sleeve can be of any configuration, open through a single pressure signal, a multi-cycle pressure signal or pressure-time based as someone skilled in the art would know.

After fracturing, the pressure-based fracking sleeve 200 may be closed. To illustrate, FIG. 4 is a side cross-sectional view of the pressure-based fracking sleeve of FIG. 3 after the sleeve is closed, according to some implementations. In this example, a sleeve 406 slides to the right to close the pressure-based fracking sleeve 200, in response to an object 402 being dropped down through the bore 206 and into a baffle 404. In some implementations, the baffle 404 is a single entry (SE) baffle. Before closing the pressure-based fracking sleeve 200, the object 402 opens the production screen sleeve positioned above. For example, with reference to FIG. 1, the object 402 opens the production screen sleeve 104 (as further described below in reference to FIGS. 5-11.

An example of the production screen sleeves 104, 110, and 116 of FIG. 1 at different stages is now described with reference to FIGS. 5-11. In particular, FIG. 5 is a side cross-sectional view of a production screen sleeve in a closed position, according to some implementations. FIG. 6 is a more detailed side cross-sectional view of a production screen sleeve in a closed position, according to some implementations. FIGS. 5-6 depict a production screen sleeve 500 having a baffle 508, a shroud 520, a piston 504, a production screen 502, and a sleeve 550. The piston 504 may be locked into a position by shear pins. There is also a bore 506 through the production screen sleeve 500. The baffle 508 may be a multi-entry (ME) baffle. Accordingly, an object may flow from the surface of the wellbore down through the bore 506 and be seated in the baffle 508 (such that this seating of the object in the baffle 508 causes pressure to build to cause the baffle 508 to move to the right). As the baffle 508 moves to the right the diameter of the opening in the baffle 508 may expand such that the object passes through the baffle 508 to the fracking sleeve below. In particular, tubing around the baffle 508 has a smaller diameter at a range 512 and has a larger diameter at a range 514. This allows the baffle 508 to expand to allow the object to pass through as the baffle 508 is moved to the right from the pressure caused by the object being seated on the baffle 508.

Figure 7:
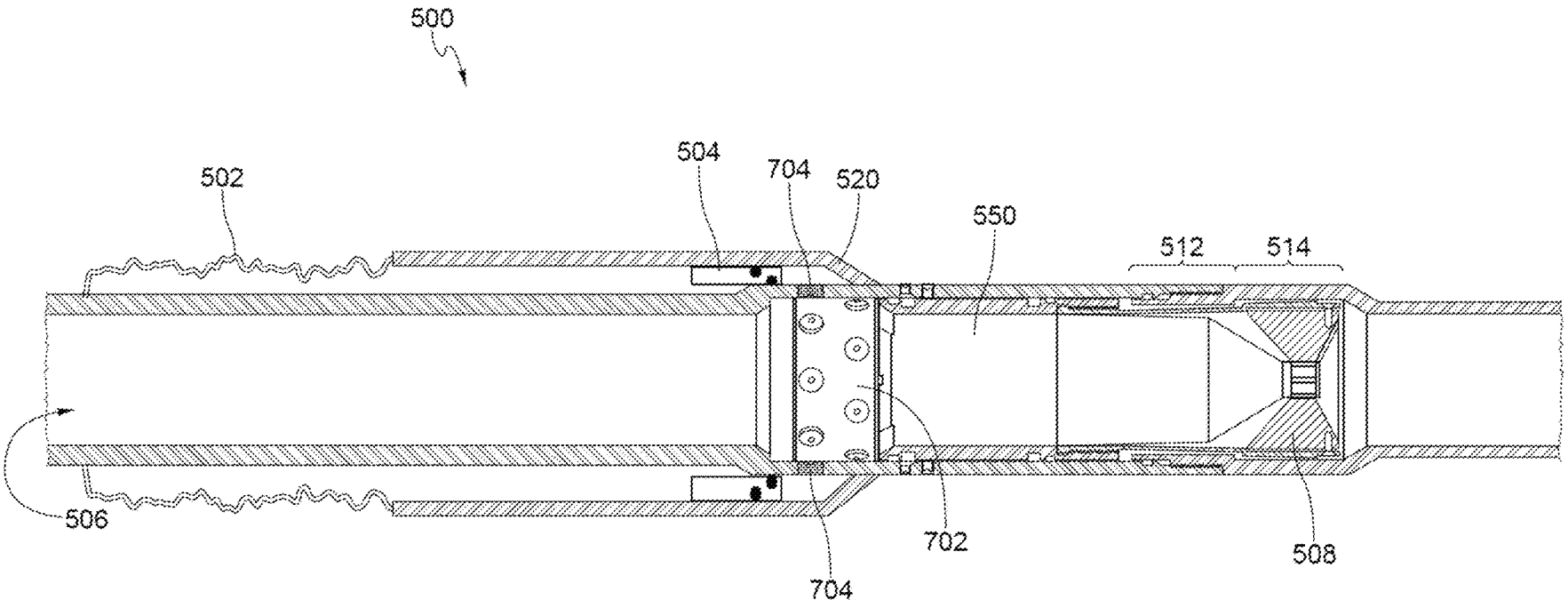
FIG. 7 is a side cross-sectional view of the production screen sleeve of FIG. 5 in an open position, according to some implementations.
Figure 8:
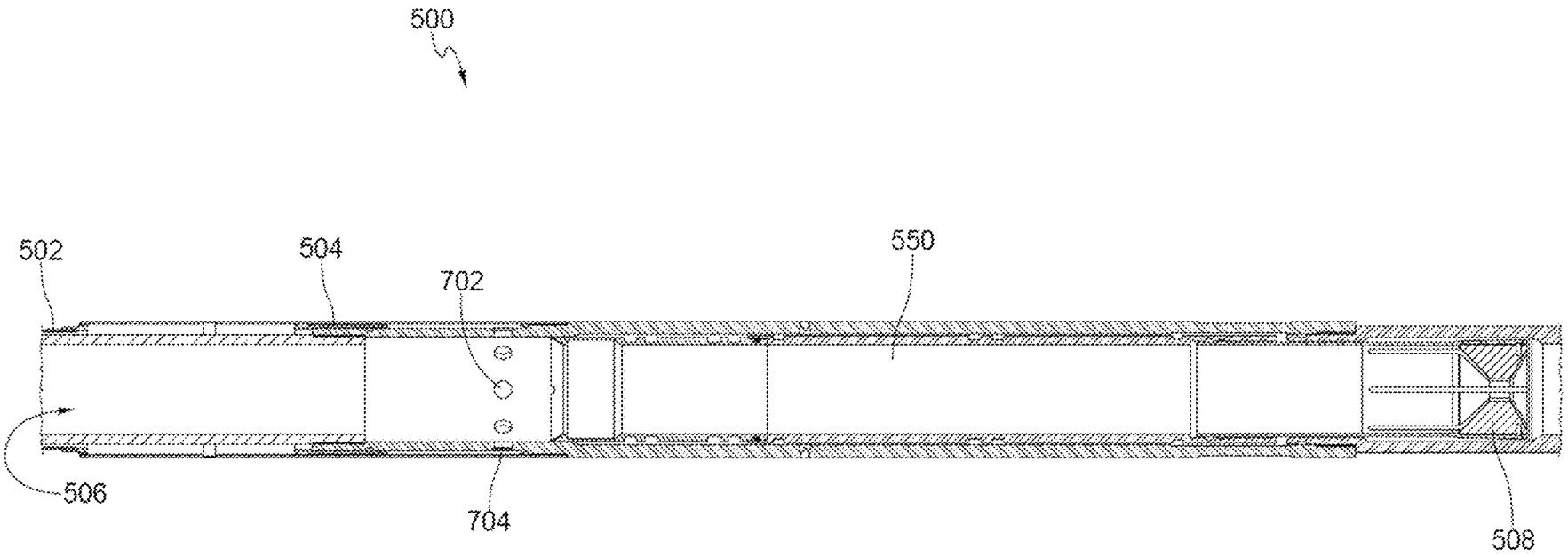
FIGS. 8-9 are more detailed side cross-sectional view of the production screen sleeve in an open position (and corresponding to FIG. 6), according to some implementations.
Figure 9:
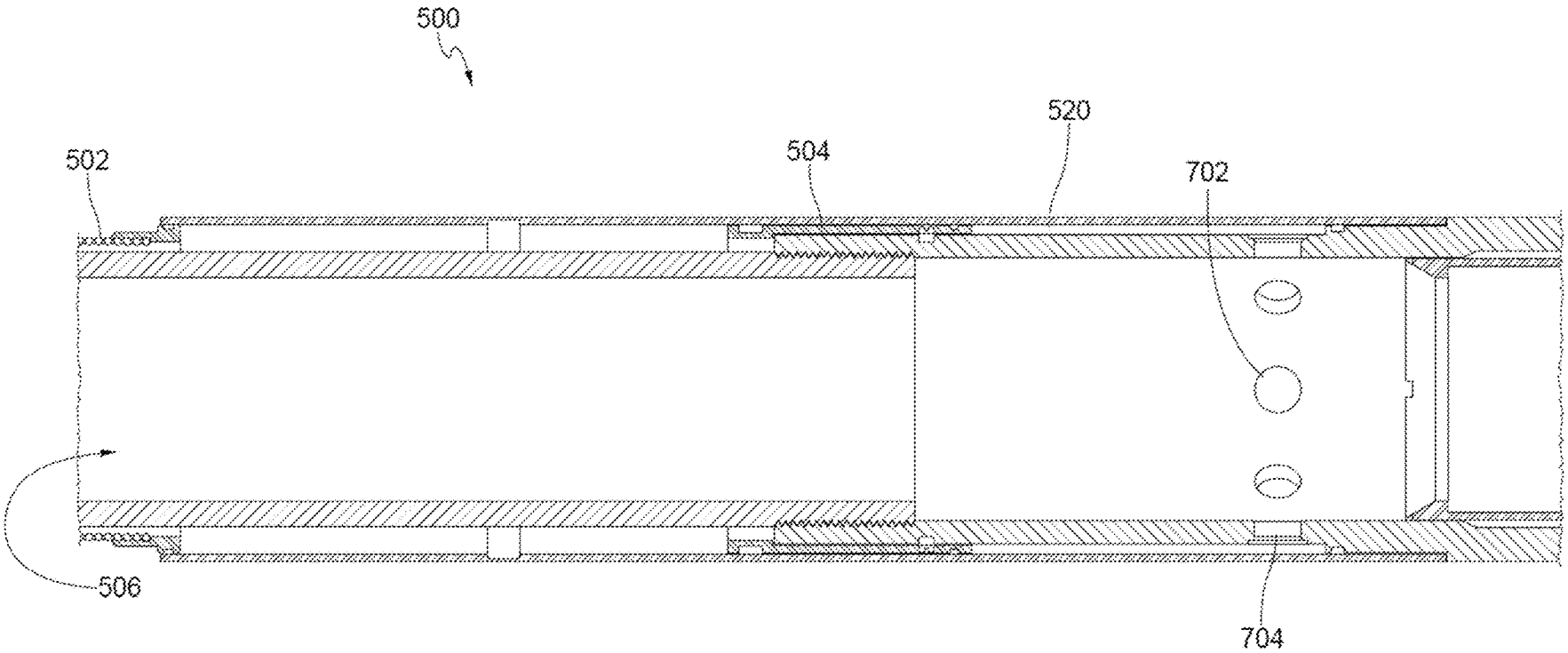

FIG. 7 is a side cross-sectional view of the production screen sleeve of FIG. 5 in an open position, according to some implementations. FIGS. 8-9 are more detailed side cross-sectional view of the production screen sleeve in an open position (and corresponding to FIG. 6), according to some implementations. As shown in FIGS. 7-8, the baffle 508 (as well as the sleeve 550) have moved to the right—because of the pressure from the object being on the baffle 508. The shift of the sleeve 550 to the right has exposed openings 702. This allows fluid flowing through the bore 506 to flow out from the openings 702 and through ports 704. The shroud 520 may retain the fluid flowing out through the ports 704 to apply pressure to the piston 504.

Figure 10:
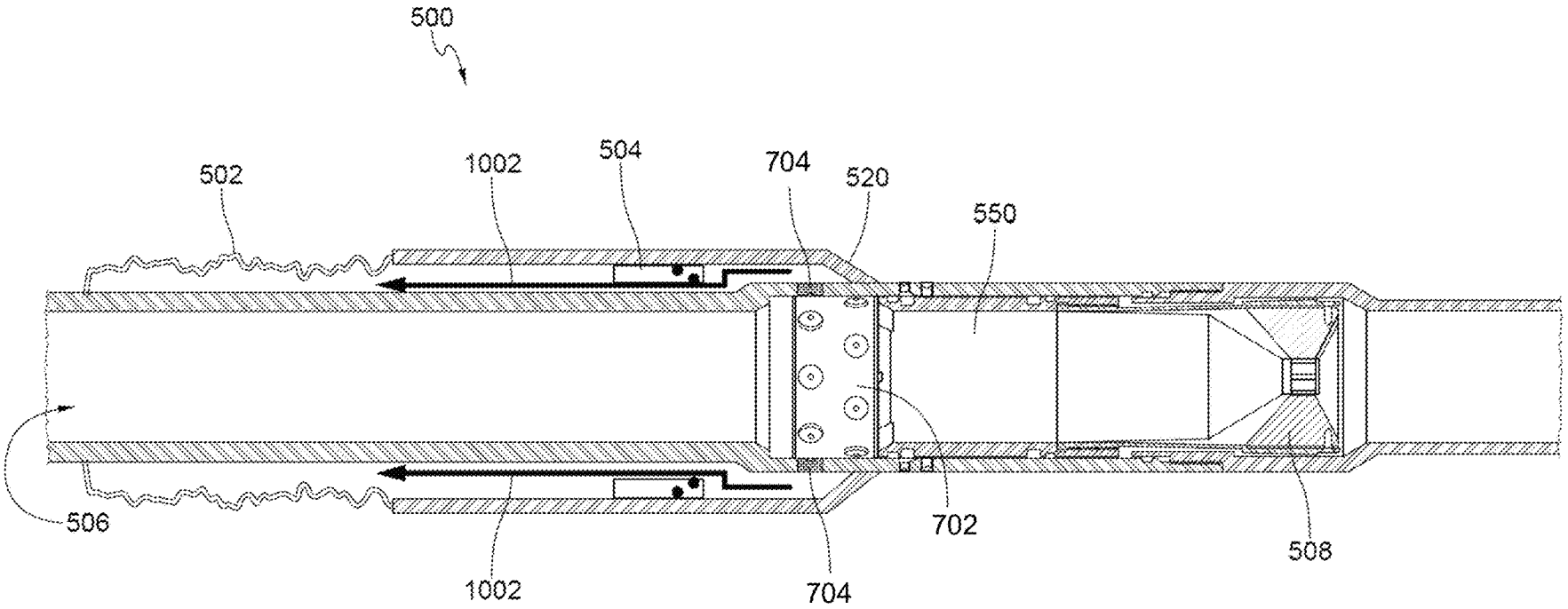
FIG. 10 is a side cross-sectional view of the production screen sleeve of FIG. 7 after the piston has moved to create a flow path to the production screen, according to some implementations.
Figure 11:
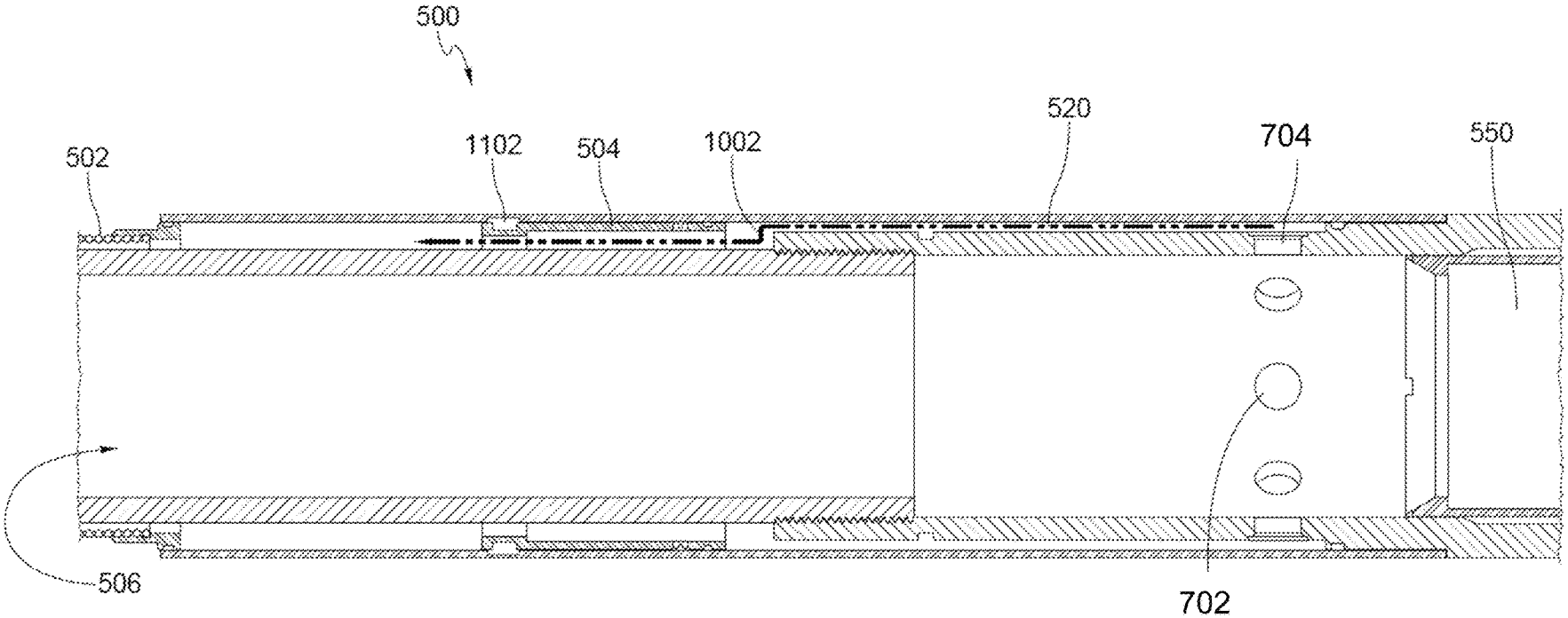
FIG. 11 is a more detailed side cross-sectional view of the production screen sleeve after the piston has moved to create a flow path to the production screen (and corresponding to FIGS. 8-9), according to some implementations.

FIG. 10 is a side cross-sectional view of the production screen sleeve of FIG. 7 after the piston has moved to create a flow path to the production screen, according to some implementations. FIG. 11 is a more detailed side cross-sectional view of the production screen sleeve after the piston has moved to create a flow path to the production screen (and corresponding to FIGS. 8-9), according to some implementations. As shown, as the fluid pressure increases, shear pins holding the piston 504 in place are sheared and the piston 504 moves to the left. This allows flow path 1002 from the ports 704 back to the production screen 502. In some implementations (as show in FIG. 11) a locking mechanism 1102 may be included into which the piston 504 is locked after moving to the left so that the piston 504 is locked into position. Examples of the locking mechanism 1102 may include a collet, a snap ring etc.

If the piston 504 is not in place the flow path back to the production screen 502 would be open. This open path may preclude enough flow to push the object through the baffle 508 to the fracking sleeve below the production screen sleeve 500. The piston 504 and how it operates allows a temporary plugging of this flow path until the flow/pressure down through the bore 506 is sufficient to move the object through the baffle 508 to the fracking sleeve below and shift it closed. Additionally, after the fracking is complete at the fracking sleeve below and before opening the production screen, a cleaning fluid (such as water) may be pumped through the bore 506 and out of the frac sleeve to clean the tubing from debris and proppant to avoid plugging the screen when it is open. Such a cleaning fluid may remove sand, proppants, etc. used during fracking. In some implementations, the flushing may occur before the multi-entry baffle sleeve of the screen is shifted.

An example of the fracking sleeves 108 and 114 of FIG. 1 at different stages is now described with reference to FIGS. 12-14. In particular, FIG. 12 is a side cross-sectional view of a fracking sleeve in a closed position, according to some implementations. FIG. 12 depicts a fracking sleeve 1200 having a sleeve 1202, a baffle 1204, a baffle 1207. The fracking sleeve 1200 also includes a shear member 1208 that initially holds the baffle 1204 in position. The fracking sleeve 1200 also includes a shear member 1210 that initially holds the baffle 1207 in position. There is also a bore 1206 in the fracking sleeve 1200 through which fluid and objects may flow. In some implementations, the baffles 1204-1207 are single entry (SE) baffles. Although not shown on all sleeves, in some implementations, all internal sleeves of the different tools may have a shifting profile. The shifting profile can be used as a contingency to manually shift the sleeves with a shifting tool run on wireline or coiled tubing.

FIG. 13 is a side cross-sectional view of the fracking sleeve of FIG. 12 in an open position, according to some implementations. As shown, an object 1320 is dropped from a surface of the wellbore and is seated in the baffle 1204. In response, the pressure from the fluid flowing through the bore 1206 (from the surface of the wellbore) causes the shear member 1208 to be sheared and the sleeve 1202 to move to the right so that the openings 1302 are revealed. A fracturing fluid may flow through the bore 1206 and out into a subsurface formation through the openings 1302 via the stimulation ports 1310.

After fracturing, the fracking sleeve 1300 may be closed. To illustrate, FIG. 14 is a side cross-sectional view of the fracking sleeve of FIG. 13 after the sleeve is closed, according to some implementations. In this example, a sleeve 1402 slides to the right to close the fracking sleeve 1200, in response to an object 1420 being dropped down through the bore 1206 and into the baffle 1207. Before closing the fracking sleeve 1200, the object 1420 opens the production screen sleeve positioned above (as described above). For example, with reference to FIG. 1, the object 402 opens the production screen sleeve 110 before opening the fracking sleeve 108. Shear pins 1210 are to be configured to shear at a lower pressure than the shear pins holding the piston 504 in production sleeve 500.

In some implementations, there may be more than one production screen sleeve for a given zone. For example, with reference to FIG. 1, there may be one or more additional production screen sleeves (in addition to the production screen sleeve 104, 110, or 116) for at least one of the first zone 152, the second zone 154, or the third zone 156, respectively.

In some implementations, each of these one or more additional production screen sleeves may have a dissolvable plug (instead of a piston) as the delay mechanism. Once an object is seated in baffle, the sleeve moves to expose the dissolvable plug to the fluid. To illustrate, FIG. 15 is a side cross-sectional view of a production screen sleeve having a dissolvable plug, according to some implementations.

Figure 15:
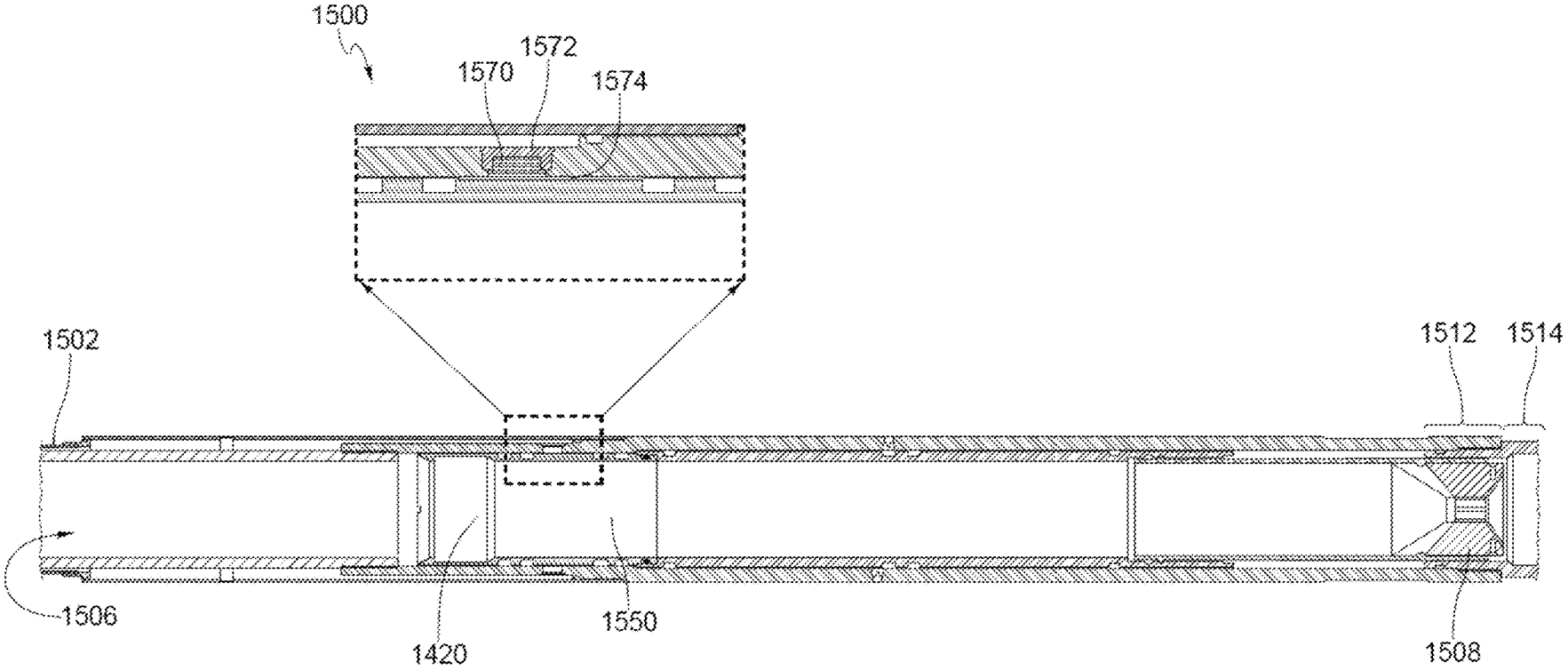
FIG. 15 is a side cross-sectional view of a production screen sleeve having a dissolvable plug, according to some implementations.

FIG. 15 depicts a production screen sleeve 1500 having a baffle 1508, a sleeve 1550, a dissolvable plug 1570, a non-dissolvable seal 1572, a production screen 1502. As shown, the dissolvable plug 1570 is initially exposed to a non-dissolvable fluid 1574 (prior to moving the production screen sleeve 1500 from a closed to an open position). In some implementations, the non-dissolvable fluid may have a pressure compensation method to keep its pressure equalized with wellbore fluid. There is also a bore 1506 through the production screen sleeve 1500.

Accordingly, a dissolvable material may plug the flow ports to prevent a flow path back to the production screen 1502. As shown, on the outer diameter side, a non-dissolvable seal protects the dissolvable plug 1570 from exposure to wellbore fluids. The inner diameter side the plug may be exposed to the non-dissolving fluid 1574 contained by O-rings. Once the sleeve 1550 is opened, the dissolvable plug 1570 may start to disintegrate by its interaction with the wellbore fluid in bore 1506. The dissolvable plug 1570 may only need to hold pressure for a few minutes till all screen sleeves below it are opened and the fracturing sleeve below is closed.

In particular, the baffle 1508 may be a multi-entry (ME) baffle. Accordingly, an object may flow from the surface of the wellbore down through the bore 1506 and be seated in the baffle 1508 (such that this seating of the object in the baffle 1508 causes pressure to build to cause the baffle 1508 and the sleeve 1550 to move to the right). As the baffle 1508 and the sleeve 1550 move to the right the diameter of the opening in the baffle 1508 may expand such that the object passes through the baffle 1508 to the fracking sleeve below. In particular, tubing around the baffle 1508 has a smaller diameter at a range 1512 and has a larger diameter at a range 1514. This allows the baffle 1508 to expand to allow the object to pass through as the baffle 1508 is moved to the right from the pressure caused by the object being seated on the baffle 1508.

In some implementations, the dissolvable plugs may be designed to be pumped out of their port at a certain pressure to establish a flow path. This pressure needs to be higher than the pressure needed to shear the shear pins 1210 of fracking sleeve 1200. Such implementations may be used instead of the screen described in FIGS. 5-11. (in that the dissolvable plugs may perform the same function as piston 504 in production screen sleeve 500).

In some implementations, one or more of the plugs may be a burst disk to open in response to pressure which would substitute the need for the piston. Other methods to open in response to pressure may also be utilized. The dissolvable plugs, burst disks and/or piston may be used individually or in any combination to achieve desired functionality.

Figure 16:
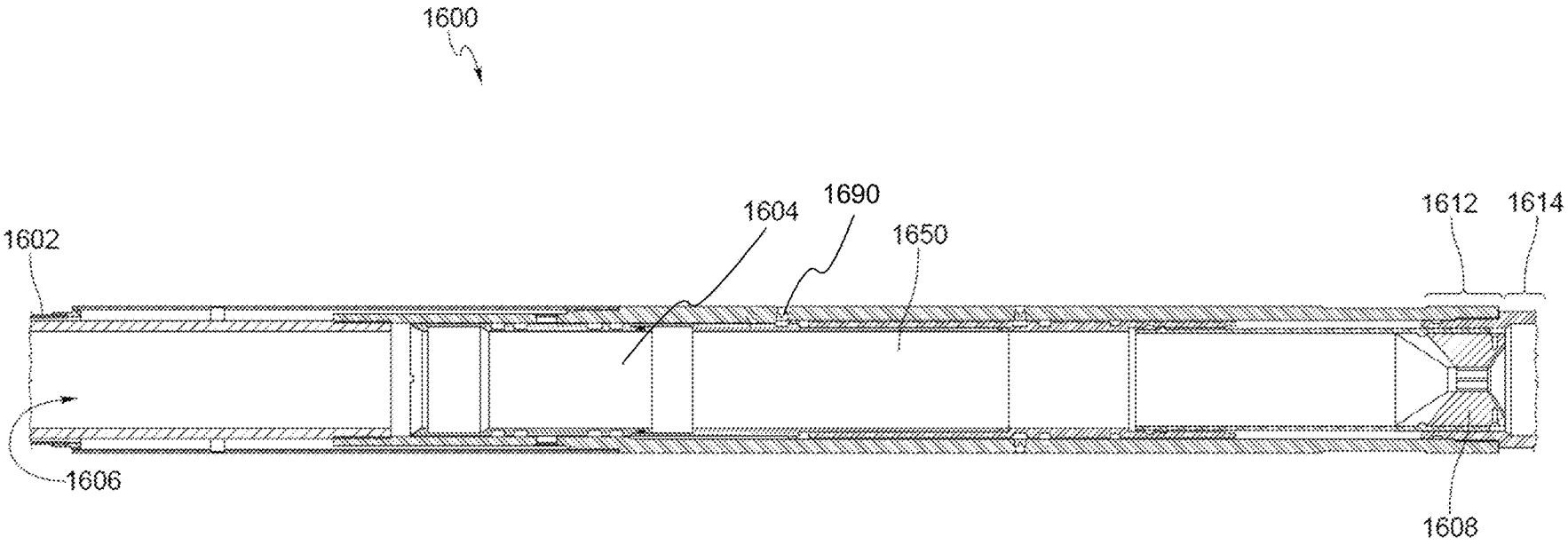
FIG. 16 is a side cross-sectional view of a production screen sleeve (having a piston in the inner diameter) in a closed position, according to some implementations.

As described above in reference to FIGS. 5-11, the piston is positioned on the outer diameter side. In some implementations, this piston may be positioned on the inner diameter side to allow contingency shifting through intervention. To illustrate, FIG. 16 is a side cross-sectional view of a production screen sleeve (having a piston in the inner diameter) in a closed position, according to some implementations. FIG. 16 depicts a production screen sleeve 1600 that includes a piston 1650 positioned in the inner diameter of the tubing. The production screen sleeve 1600 also includes a production screen 1602, a sleeve 1604 and a baffle 1608.

There is also a bore 1606 through the production screen sleeve 1600. The baffle 1608 may be a multi-entry (ME) baffle. Accordingly, an object may flow from the surface of the wellbore down through the bore 1606 and be seated in the baffle 1608 (such that this seating of the object in the baffle 1608 causes pressure to build to cause the baffle 1608 to move to the right). As the baffle 1608 moves to the right the diameter of the opening in the baffle 1608 may expand such that the object passes through the baffle 1608 to the fracking sleeve below. In particular, tubing around the baffle 1608 has a smaller diameter at a range 1612 and a larger diameter at a range 1614. This allows the baffle 1608 to expand to allow the object to pass through as the baffle 1608 is moved to the right from the pressure caused by the object being seated on the baffle 1608.

Figure 17:
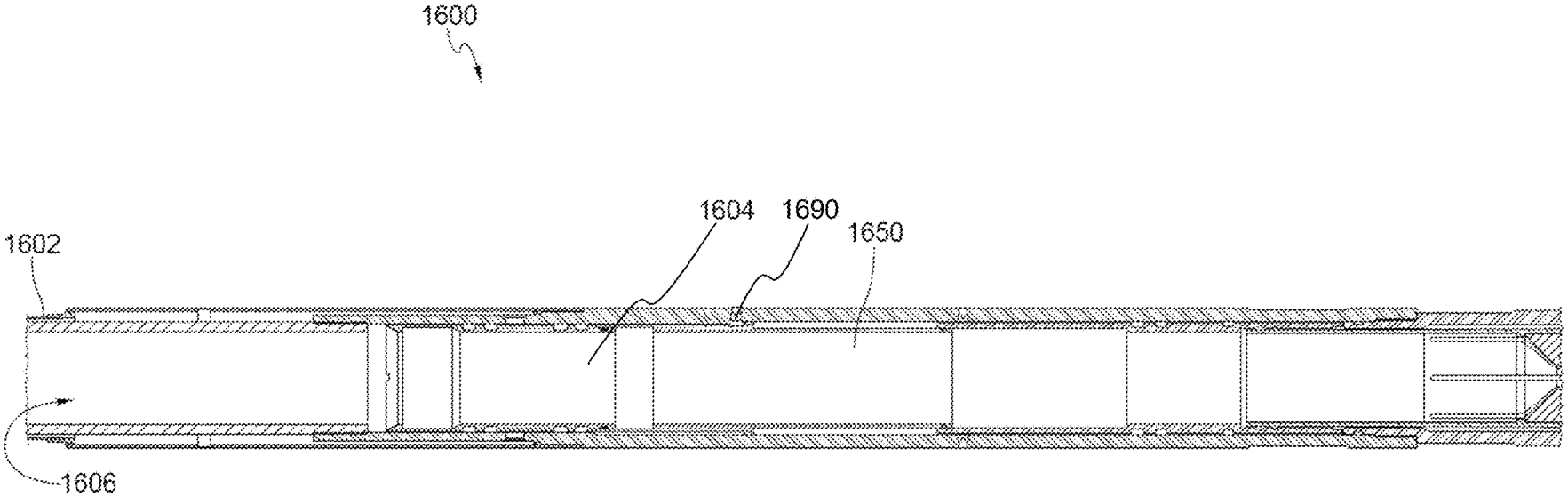
FIG. 17-19 are side cross-sectional views of a production screen sleeve of FIG. 16 after the production screen sleeve is moved from a closed to an open position, according to some implementations.
Figure 18:
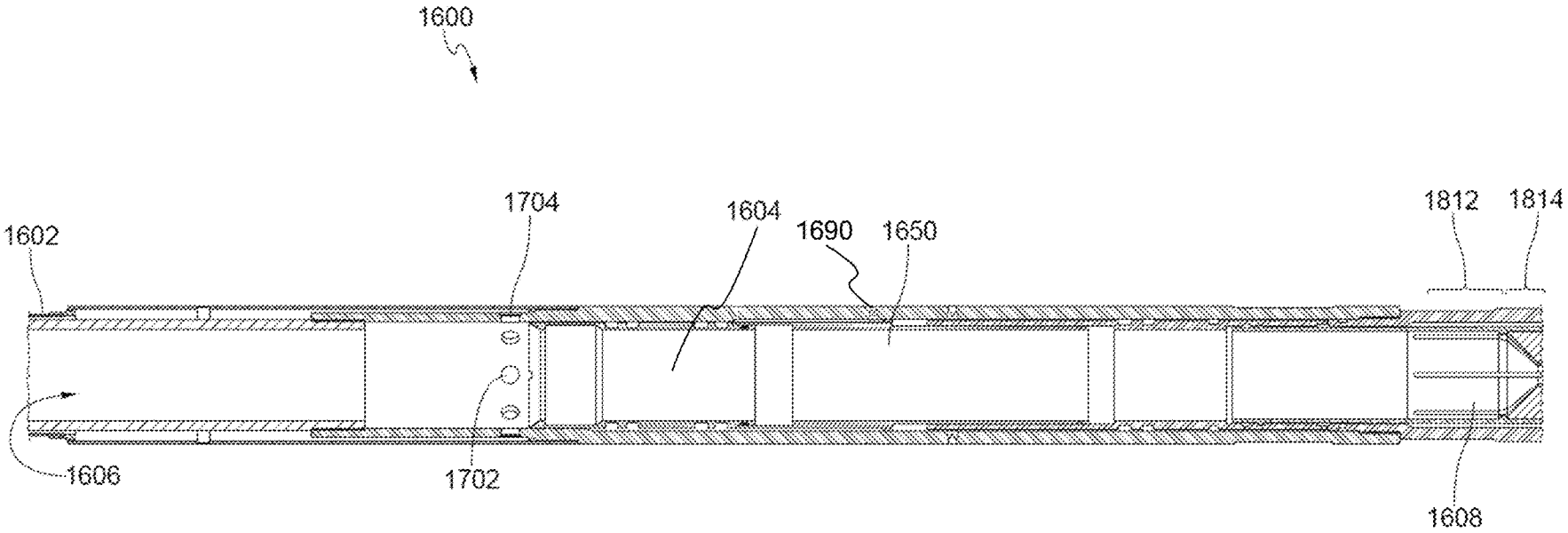
Figure 19:
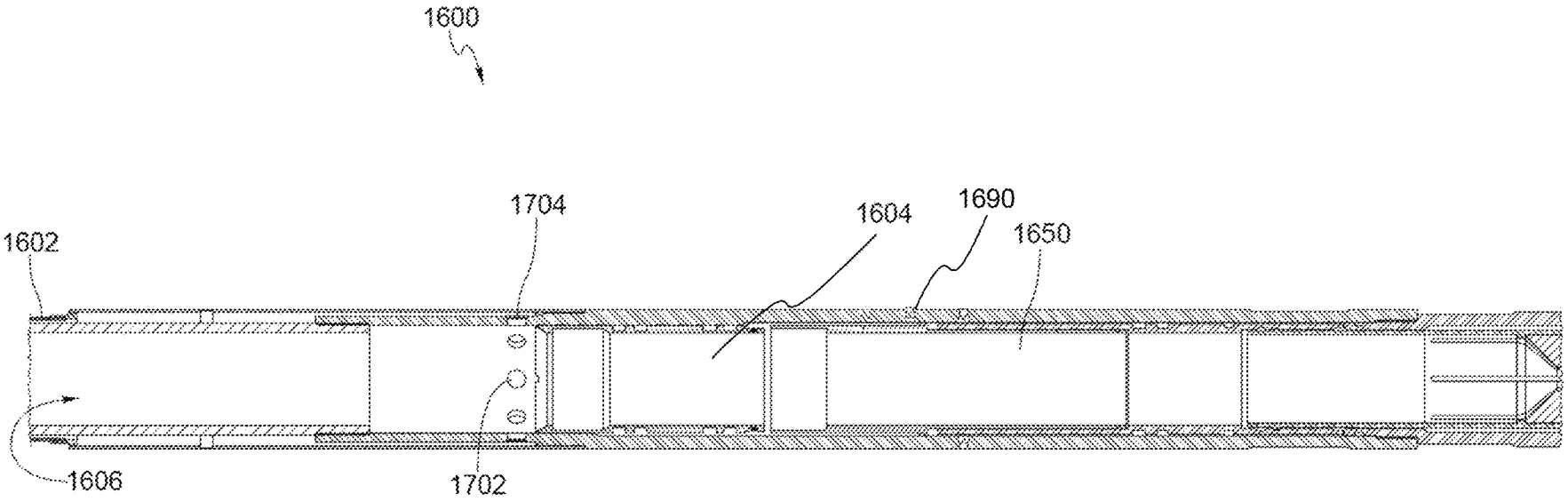

FIG. 17-19 are side cross-sectional views of a production screen sleeve of FIG. 16 after the production screen sleeve is moved from a closed to an open position, according to some implementations. As shown in FIG. 18, the baffle 1608 has moved to the right—because of the pressure from the object being on the baffle 1608.

In some implementations, the piston 1650 is a biased piston that will only shift downhole when the wellbore pressure is sufficient to shear shear-pins 1690. When this pressure (which should be configured to be higher than the pressure required to shear shear-pins 1210 of fracking sleeve 1200) is reached piston 1650 and sleeve 1604 move downhole as shown in FIG. 18. The shift of the sleeve 1604 to the right has exposed openings 1702. This allows fluid flowing through the bore 1606 to flow out from the openings 1702 and through ports 1704.

The piston 1650 and the sleeve 1604 may be configured to have a detachable connection. This connection may be configured to allow the sleeve 1604 to be pulled down by piston 1650 but detaches at the end of the stroke. This may be achieved by a snap ring or collet that expands outwards in a larger ID when stroked all the way open. This allows a shifting tool to engage the sleeve 1604 and shift it upwards to shut off production in the future if that zone is producing water.

Example Operations

Figure 20:
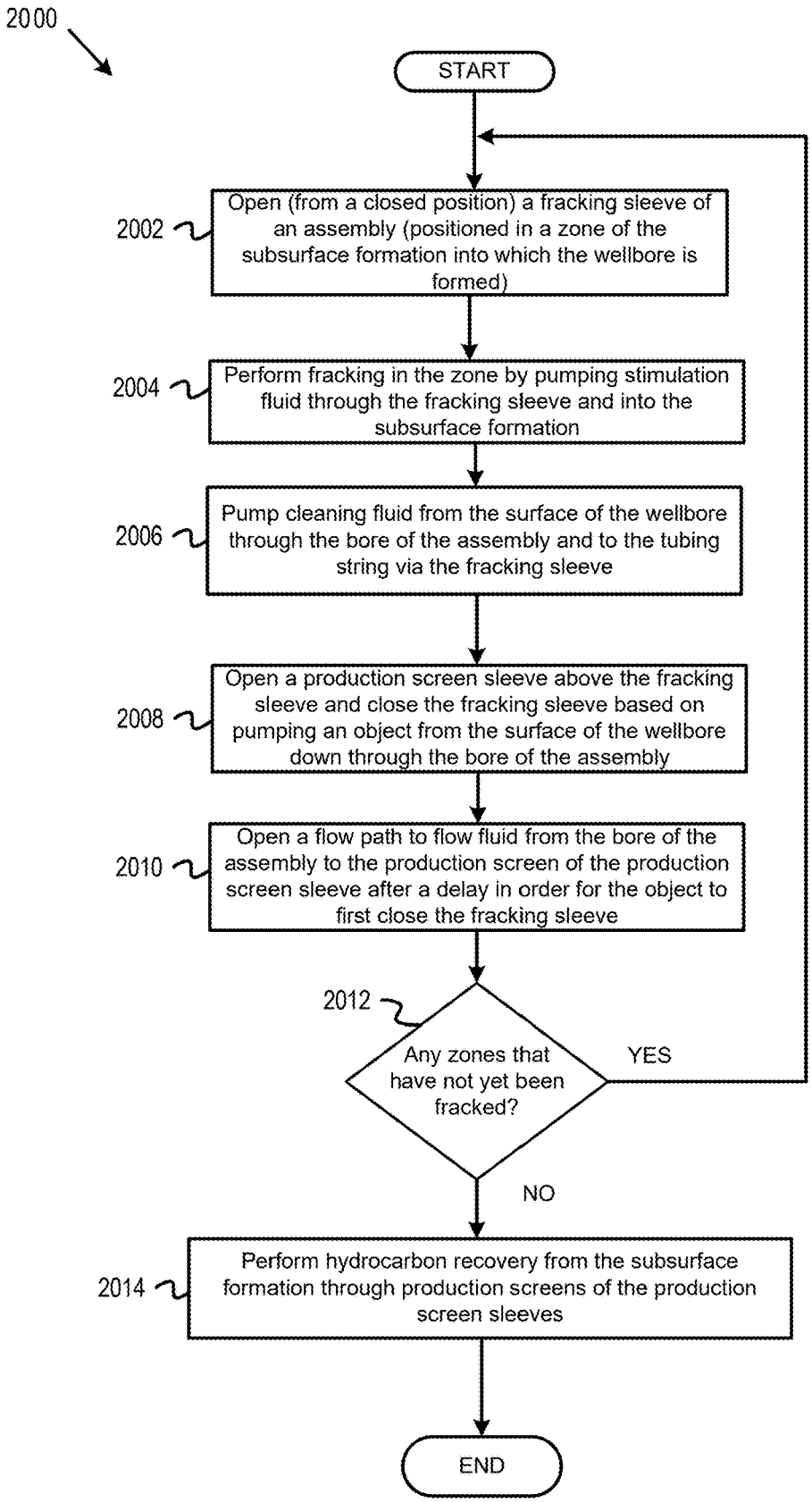
FIG. 20 is a flowchart of example operations for a multi-stage wellbore stimulation, according to some implementations.

Example operations for a multi-stage wellbore stimulation are now described. In particular, FIG. 20 is a flowchart of example operations for a multi-stage wellbore stimulation, according to some implementations. Operations of a flowchart 2000 of FIG. 20 may be performed by software, firmware, hardware, or a combination thereof. Operations of the flowchart 2000 are described in reference to the example of sleeves of FIGS. 1-19. However, other systems and components may be used to perform the operations now described. The operations of the flowchart 2000 start at block 2002.

At block 2002, a fracking sleeve of an assembly (positioned in a zone of the subsurface formation into which the wellbore is formed) is opened (from a closed position). For example, with reference to FIG. 1, the tool initiator sub 102 (that is a fracking sleeve) may be opened using a pressure of the flow of the fluid (as described above). In another example, with reference to FIG. 1, the fracking sleeve 108 or 114 may be opened by dropping an object into a baffle (as described above).

At block 2004, fracking in the zone is performed by pumping stimulation fluid through the fracking sleeve and into the subsurface formation. For example, with reference to FIG. 1, whichever tool initiator sub 102 (also a fracking sleeve) or the fracking sleeves 108 or 114 has been opened is the fracking sleeve through which the stimulation fluid may be pumped for fracking the subsurface formation.

At block 2006, cleaning fluid is pumped from the surface of the wellbore through the bore of the assembly to clean the tubing string via the fracking sleeve. For example, instead of a stimulation fluid, a cleaning fluid (such as water) may be opened from the surface of the wellbore and through the fracking sleeve to clean the tubing string (as described above).

At block 2008, a production screen sleeve above the fracking sleeve is opened and the fracking sleeve is closed based on pumping an object from the surface of the wellbore down through the bore of the assembly. For example, with reference to FIG. 1, assume that the fracking sleeve that is opened and through which the fracking has been performed is the fracking sleeve 108. The production screen sleeve 110 would be opened and the fracking sleeve 108 would be closed based on pumping an object from the surface of the wellbore and down through the bore of the assembly (as described above).

At block 2010, a flow path is opened to flow fluid from the bore of the assembly to the production screen of the production screen sleeve after a delay in order for the object to first close the fracking sleeve. For example, with reference to FIG. 10, the flow path 1002 is opened by moving the piston 504 to the right (as described above). In some implementations, the flow path may be opened by dissolving dissolvable plugs or pumping such plugs out.

At block 2012, a determination is made of whether there are any zones that have not yet been fracked. For example, with reference to FIG. 1, there are three zones (the first zone 152, the second zone 154, and the third zone 156) such that the first zone 152 is fracked, followed by the second zone 154 being fracked and followed by the third zone 156 being fracked. If the third zone 156 has been fracked, then there are not any zones that have not been fracked. If there are any zones that have not yet been fracked, operations of the flowchart 2000 return to block 2002 to open a fracking sleeve for a zone that has not yet been fracked. Otherwise, operations of the flowchart 2000 continue at block 2014.

At block 2014, hydrocarbon recovery is performed from the subsurface formation through production screens of the production screen sleeves. For example, with reference to FIG. 1, hydrocarbons may flow through the production screens of each of the production screen sleeves 104, 110, and 116 and up the bore to a surface of the wellbore.

Example System

An example system having sleeves for a multi-stage wellbore stimulation is now described. In particular, FIG. 21 is an elevation view in partial cross section of a well system having sleeves for multi-stage stimulation, according to some implementations.

Figure 21:
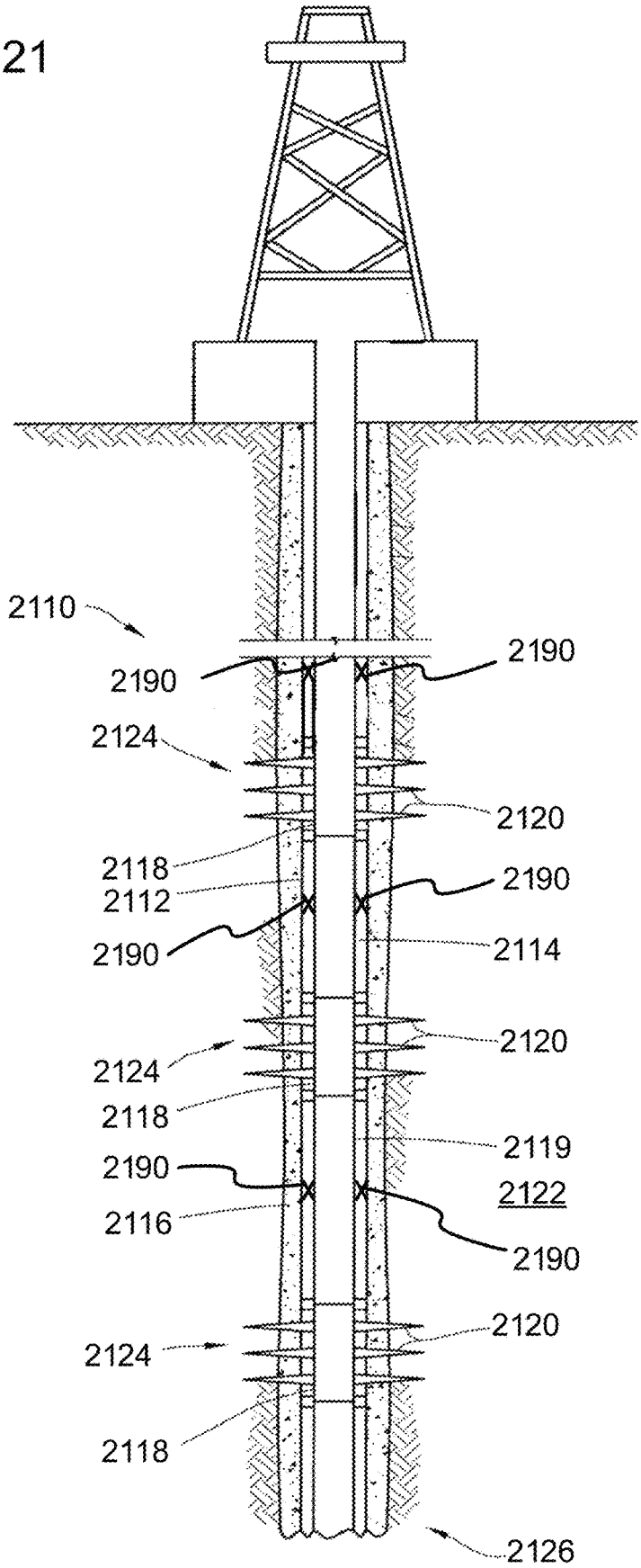
FIG. 21 is an elevation view in partial cross section of a well system having sleeves for multi-stage stimulation, according to some implementations.

FIG. 21 includes a multi-zone fracturing system (hereinafter "system) 2110. As illustrated, the system 2110 may be disposed in a wellbore 2112 lined with a casing 2114 and a cement 2116. The system 2110 may include multiple sleeves 2118 positioned in the wellbore 2112 and installed along the casing 2114. The sleeves 2118 may be run in on a production string 2119. As used herein, the term "casing" is intended to be understood broadly as referring to casing and/or liners. The sleeves 2118 may be positioned at predetermined locations along the length of the wellbore 2112. These locations may correspond to the formation of perforations 2120 through the casing 2114 and cement 2116, and outward into a subsurface formation 2122 surrounding the wellbore 2112. Examples of the sleeves 2118 are depicted in FIGS. 1-19 (described above). As described above, the sleeves 2118 may be selectively opened to provide access from an interior of the wellbore 2112 surrounded by the casing 2114 to the formation 2122.

As illustrated, any number of sleeves 2118 may be positioned along the length of the wellbore 2112 in order to accommodate selective exposure of different zones 2124 of the formation 2122 to the wellbore 2112. This may be particularly desirable when perforating the different zones 2124 of the formation 2122 or providing fracture treatments to previously formed perforations 2120 or in open hole sections (no casing) at the different zones 2124. The different zones 2124 may be isolated using packers 2190.

While FIG. 21 depicts the system 2110 as being arranged along a vertically oriented portion of the wellbore 2112, it will be appreciated that the system 2110 may be equally arranged in a horizontal or slanted portion of the wellbore 2112, or any other angular configuration therebetween. Additionally, the system 2110 may be arranged along other portions of the vertical wellbore 2112 in order to provide access to the formation 2122 at a location closer to a toe portion 2126 of the wellbore 2112.

While the aspects of the disclosure are described with reference to various implementations and exploitations, it will be understood that these aspects are illustrative and that the scope of the claims is not limited to them. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

Example Implementations

Implementation #1: An assembly for incorporation into a completion string and to be positioned in a wellbore formed in a subsurface formation, the assembly comprising: a tubular housing having a bore therethrough and at least one stimulation port therein to communicate bore fluid from the bore to outside the tubular housing; and a fracking sleeve axially movable in the tubular housing, the fracking sleeve comprising, a closing fracking baffle; wherein the fracking sleeve is initially in a closed position, wherein the fracking sleeve is to axially move from the closed position to an open position to open the at least one stimulation port to communicate a flow of the bore fluid out to the subsurface formation; wherein the fracking sleeve is to axially move from the open position to the closed position in response to the closing fracking baffle receiving an object received therein; and a production screen sleeve positioned above the fracking sleeve and axially movable in the tubular housing, wherein the production screen sleeve comprises, a production baffle configured to move from a closed position to an open position upon receipt of a second object before being received by the closing fracking baffle; and a production screen through which production fluid from the subsurface formation is to be received.

Implementation #2: The assembly of Implementation #1, wherein the fracking sleeve comprises an opening fracking baffle, and wherein the fracking sleeve is to axially move from the closed position to the open position to open the at least one stimulation port to communicate the flow of the bore fluid out to the subsurface formation, in response to the opening fracking baffle receiving an initial object therein.

Implementation #3: The assembly of any one of Implementations #1-2, wherein the fracking sleeve is to axially move from the closed position to the open position to open the at least one stimulation port to communicate the flow of the bore fluid out to the subsurface formation, in response to a pressure build up in the bore fluid of the fracking sleeve.

Implementation #4: The assembly of any one of Implementations #1-3, wherein the production screen sleeve comprises a delay mechanism to initially inhibit flow of the bore fluid from the bore through the production screen sleeve back to the production screen such that the delay mechanism is configured to open to enable the flow of the fluid back to the production screen after a delay.

Implementation #5: The assembly of Implementation #4, wherein the delay mechanism comprises at least one of, a piston that is to move to open a flow path to the production screen based on a pressure of the bore fluid, a dissolvable plug that is to dissolve over time based on exposure to the bore fluid, a pumpable dissolvable plug, and a burst disk.

Implementation #6: The assembly of any one of Implementations #1-5, wherein the objects comprise dissolvable objects that would provide pressure isolation when landing on their respective seat but self disintegrate over time to provide unobstructed production flow.

Implementation #7: The assembly of any one of Implementations #1-7, wherein the sleeves have a shifting profile to allow contingency shifting using a shifting tool.

Implementation #8: The assembly of any one of Implementations #1-7, wherein the production sleeve chokes the flow enough to allow the object to continue downhole and build pressure to close the frac sleeve below but at the same time allows enough flow to pump down the next object to open the frac sleeve above.

Implementation #9: A method comprising: opening a fracking sleeve that is part of an assembly having a bore and that is positioned in a wellbore formed in a subsurface formation; performing fracking of the subsurface formation using a bore fluid that is flowing through the bore and out into the subsurface formation via the fracking sleeve that is opened; and after performing the fracking and in response to dropping an object from a surface of the wellbore and down through the bore, opening a production screen sleeve of the assembly that is positioned above the fracking sleeve, wherein the production screen sleeve comprises a production screen; and closing the fracking sleeve.

Implementation #10: The method of Implementation #9, wherein the fracking sleeve comprises an opening fracking baffle, and wherein opening the fracking sleeve comprises axially moving the fracking sleeve from the closed position to the open position to open at least one stimulation port to communicate the flow of the bore fluid out to the subsurface formation, in response to the opening fracking baffle receiving an initial object therein.

Implementation #11: The method of any one of Implementations #9-10, wherein opening the fracking sleeve comprises axially moving fracking sleeve from the closed position to the open position to open at least one stimulation port to communicate the flow of the bore fluid out to the subsurface formation, in response to a pressure build up in the bore fluid of the fracking sleeve.

Implementation #12: The method of any one of Implementations #9-11, wherein the object comprises a dissolvable object that would provide pressure isolation when landing their respective seat but self disintegrate over time to provide unobstructed production flow.

Implementation #13: The method of any one of Implementations #9-12, wherein the fracking sleeve and the production screen sleeve have a shifting profile to allow contingency shifting using a shifting tool.

Implementation #14: The method of any one of Implementations #9-13, wherein the production screen sleeve comprises a delay mechanism that is used to delay the opening of the production screen until the fracking sleeve is closed.

Implementation #15: The method of any one of Implementations #9-14, wherein the delay mechanism comprises at least one of, a piston that is to move to open a flow path to the production screen based on a pressure of the bore fluid, a dissolvable plug that is to dissolve over time based on exposure to the bore fluid, a pumpable dissolvable plug, and a burst disk.

Implementation #16: A system for incorporation into a completion string and to be positioned in a wellbore formed in a subsurface formation, the system comprising: a tubular housing having a bore therethrough and at least one stimulation port therein to communicate bore fluid from the bore to outside the tubular housing; and a fracking sleeve axially movable in the tubular housing, the fracking sleeve comprising, a closing fracking baffle; and an opening fracking baffle; wherein the fracking sleeve is to axially move from being closed to being open to open the at least one stimulation port to communicate a flow of the bore fluid out to the subsurface formation, in response to the closing fracking baffle receiving a first object, via the bore and dropped from a surface of the wellbore; wherein, after fracking of the subsurface formation using bore fluid flowing through the bore and through the fracking sleeve and out into the subsurface formation, the fracking sleeve is to axially move from being open to being closed in response to the opening fracking baffle receiving a second object, via the bore and dropped from the surface of the wellbore received therein; and a production screen sleeve positioned above the fracking sleeve and axially movable in the tubular housing, wherein the production screen sleeve comprises, a production baffle configured to move from a closed position to an open position upon receipt of the second object before being received by the closing fracking baffle; and a production screen through which production fluid from the subsurface formation is to be received.

Implementation #17: The assembly of Implementation #16, wherein the production screen sleeve comprises a delay mechanism to initially inhibit flow of the bore fluid from the bore through the production screen sleeve back to the production screen such that the delay mechanism is configured to open to enable the flow of the fluid back to the production screen after a delay.

Implementation #18: The assembly of any one of Implementations #16-17, wherein the delay mechanism comprises at least one of, a piston that is to move to open a flow path to the production screen based on a pressure of the bore fluid, a dissolvable plug that is to dissolve over time based on exposure to the bore fluid, a pumpable dissolvable plug, and a burst disk.

Implementation #19: The assembly of Implementations #16-18, wherein the objects comprises a dissolvable object that would provide pressure isolation when landing their respective seat but self disintegrate over time to provide unobstructed production flow.

Implementation #20: The assembly of Implementations #16-19, wherein the sleeves have a shifting profile to allow contingency shifting using a shifting tool.

The invention claimed is:

1. An assembly for incorporation into a completion string and to be positioned in a wellbore formed in a subsurface formation, the assembly comprising:

a tubular housing having a bore therethrough and at least one stimulation port therein to communicate bore fluid from the bore to outside the tubular housing; and a fracking sleeve axially movable in the tubular housing, the fracking sleeve comprising, a closing fracking baffle;

wherein the fracking sleeve is initially in a closed position, wherein the fracking sleeve is to axially move from the closed position to an open position to open the at least one stimulation port to communicate a flow of the bore fluid out to the subsurface formation;

wherein the fracking sleeve is to axially move from the open position to the closed position in response to the closing fracking baffle receiving an object received therein; and a production screen sleeve positioned above the fracking sleeve and axially movable in the tubular housing, wherein the production screen sleeve comprises, a production baffle configured to move the production screen sleeve from a closed position to an open position upon receipt of a second object before being received by the closing fracking baffle; and a production screen through which production fluid from the subsurface formation is to be received.

2. The assembly of claim 1, wherein the fracking sleeve comprises an opening fracking baffle, wherein the opening fracking baffle is a single entry baffle, and wherein the fracking sleeve is to axially move from the closed position to the open position to open the at least one stimulation port to communicate the flow of the bore fluid out to the subsurface formation, in response to the opening fracking baffle receiving an initial object therein.

3. The assembly of claim 1, wherein the fracking sleeve is to axially move from the closed position to the open position to open the at least one stimulation port to communicate the flow of the bore fluid out to the subsurface formation, in response to a pressure build up in the bore fluid of the fracking sleeve.

4. The assembly of claim 1, wherein the production screen sleeve comprises a delay mechanism to initially inhibit flow of the bore fluid from the bore through the production screen sleeve back to the production screen such that the delay mechanism is configured to open to enable the flow of the fluid back to the production screen after a delay.

5. The assembly of claim 4, wherein the delay mechanism comprises at least one of, a piston that is to move to open a flow path to the production screen based on a pressure of the bore fluid, a dissolvable plug that is to dissolve over time based on exposure to the bore fluid, a pumpable dissolvable plug, or a burst disk.

6. The assembly of claim 2, wherein the objects comprise dissolvable objects that would provide pressure isolation when landing on their respective baffle but self disintegrate over time to provide unobstructed production flow.

7. The assembly of claim 1, wherein the sleeves have a shifting profile to allow contingency shifting using a shifting tool.

8. The assembly of claim 1 where the production sleeve chokes the flow enough to allow the object to continue downhole and build pressure to close the frac sleeve below but at the same time allows enough flow to pump down the next object to open the frac sleeve above.

9. A method comprising:

opening a fracking sleeve that is part of an assembly having a bore and that is positioned in a wellbore formed in a subsurface formation;

performing fracking of the subsurface formation using a bore fluid that is flowing through the bore and out into the subsurface formation via the fracking sleeve that is opened; and after performing the fracking and in response to dropping an object from a surface of the wellbore and down through the bore, opening a production screen sleeve of the assembly that is positioned above the fracking sleeve, wherein the production screen sleeve comprises a production screen, wherein the production screen sleeve comprises a production baffle configured to move the production sleeve from a closed position to an open position upon receipt of a second object; and closing the fracking sleeve.

10. The method of claim 9, wherein the fracking sleeve comprises an opening fracking baffle, wherein the opening fracking baffle is a single entry baffle, and wherein opening the fracking sleeve comprises axially moving the fracking sleeve from the closed position to the open position to open at least one stimulation port to communicate the flow of the bore fluid out to the subsurface formation, in response to the opening fracking baffle receiving an initial object therein.

11. The method of claim 9, wherein opening the fracking sleeve comprises axially moving fracking sleeve from the closed position to the open position to open at least one stimulation port to communicate the flow of the bore fluid out to the subsurface formation, in response to a pressure build up in the bore fluid of the fracking sleeve.

12. The method of claim 9, wherein the object comprises a dissolvable object that would provide pressure isolation when landing on their respective baffle but self disintegrate over time to provide unobstructed production flow.

13. The method of claim 9, wherein the fracking sleeve and the production screen sleeve have a shifting profile to allow contingency shifting using a shifting tool.

14. The method of claim 9, wherein the production screen sleeve comprises a delay mechanism that is used to delay the opening of the production screen until the fracking sleeve is closed.

15. The method of claim 9, wherein the delay mechanism comprises at least one of, a piston that is to move to open a flow path to the production screen based on a pressure of the bore fluid, a dissolvable plug that is to dissolve over time based on exposure to the bore fluid, a pumpable dissolvable plug, or a burst disk.

16. A system for incorporation into a completion string and to be positioned in a wellbore formed in a subsurface formation, the system comprising:

a tubular housing having a bore therethrough and at least one stimulation port therein to communicate bore fluid from the bore to outside the tubular housing; and a fracking sleeve axially movable in the tubular housing, the fracking sleeve comprising, a closing fracking baffle; and an opening fracking baffle;

wherein the fracking sleeve is to axially move from being closed to being open to open the at least one stimulation port to communicate a flow of the bore fluid out to the subsurface formation, in response to the closing fracking baffle receiving a first object, via the bore and dropped from a surface of the wellbore;

wherein, after fracking of the subsurface formation using bore fluid flowing through the bore and through the fracking sleeve and out into the subsurface formation, the fracking sleeve is to axially move from being open to being closed in response to the opening fracking baffle receiving a second object, via the bore and dropped from the surface of the wellbore received therein; and a production screen sleeve positioned above the fracking sleeve and axially movable in the tubular housing, wherein the production screen sleeve comprises, a production baffle configured to move the production screen sleeve from a closed position to an open position upon receipt of the second object before being received by the closing fracking baffle; and a production screen through which production fluid from the subsurface formation is to be received.

17. The system of claim 16, wherein the production screen sleeve comprises a delay mechanism to initially inhibit flow of the bore fluid from the bore through the production screen sleeve back to the production screen such that the delay mechanism is configured to open to enable the flow of the fluid back to the production screen after a delay.

18. The system of claim 17, wherein the delay mechanism comprises at least one of, a piston that is to move to open a flow path to the production screen based on a pressure of the bore fluid, a dissolvable plug that is to dissolve over time based on exposure to the bore fluid, a pumpable dissolvable plug, or a burst disk.

19. The system of claim 16, wherein the objects comprises a dissolvable object that would provide pressure isolation when landing on their respective baffle but self disintegrate over time to provide unobstructed production flow.

20. The system of claim 16, wherein the sleeves have a shifting profile to allow contingency shifting using a shifting tool.

* * * * *